US010434358B2

(12) United States Patent
Chen

(10) Patent No.: US 10,434,358 B2
(45) Date of Patent: Oct. 8, 2019

(54) EXERCISE WEIGHTS AND METHODS OF MAKING EXERCISE WEIGHTS

(71) Applicant: Jenkins Asia Tech (Shanghai) Limited, Shanghai (CN)

(72) Inventor: Weng Kin Chen, Shanghai (CN)

(73) Assignee: Jenkins Asia Tech (Shanghai) Limited (CN)

( * ) Notice: Subject to any disclaimer, the term of this patent is extended or adjusted under 35 U.S.C. 154(b) by 0 days.

(21) Appl. No.: 15/716,134

(22) Filed: Sep. 26, 2017

(65) Prior Publication Data

US 2018/0085619 A1 Mar. 29, 2018

Related U.S. Application Data

(60) Provisional application No. 62/400,558, filed on Sep. 27, 2016.

(51) Int. Cl.

| | |
|---|---|
| ***A63B 21/06*** | (2006.01) |
| ***A63B 21/00*** | (2006.01) |
| ***A63B 21/072*** | (2006.01) |
| ***A63B 23/02*** | (2006.01) |
| ***A63B 23/035*** | (2006.01) |
| ***A63B 23/12*** | (2006.01) |

(52) U.S. Cl.

CPC ..... *A63B 21/0603* (2013.01); *A63B 21/072* (2013.01); *A63B 21/4035* (2015.10); *A63B 23/0205* (2013.01); *A63B 23/0355* (2013.01); *A63B 23/12* (2013.01); *A63B 2209/00* (2013.01)

(58) Field of Classification Search

CPC ..... A63B 23/12; A63B 23/1209

See application file for complete search history.

(56) References Cited

U.S. PATENT DOCUMENTS

| | | | | | |
|---|---|---|---|---|---|
| 3,332,166 | A | * | 7/1967 | Alexander | A63H 33/02 446/153 |
| 4,017,927 | A | * | 4/1977 | Massey | B63C 9/082 264/DIG. 4 |
| D244,628 | S | * | 6/1977 | Wright | D21/682 |
| 4,029,312 | A | * | 6/1977 | Wright | A63B 21/0602 482/106 |
| 4,356,915 | A | * | 11/1982 | Phillips | B65D 85/58 206/315.1 |
| 4,632,391 | A | * | 12/1986 | Orak | A63B 21/0608 446/170 |
| D301,510 | S | * | 6/1989 | Orak | D21/684 |
| D302,195 | S | * | 7/1989 | Orak | D21/682 |
| 4,854,575 | A | * | 8/1989 | Wilson | A63B 21/0602 482/108 |
| 5,139,472 | A | * | 8/1992 | Caruthers | A63B 21/0605 482/139 |

(Continued)

*Primary Examiner* — Garrett K Atkinson

(74) *Attorney, Agent, or Firm* — Levine Bagade Han LLP

(57) ABSTRACT

Exercise weights and methods of making exercise weights are disclosed. In one embodiment, the exercise weight comprises a weight housing comprising a central portion and a plurality of handle sleeves extending from a periphery of the central portion. The central portion is fillable by a weighted filling material. A handle component surrounds the central portion and portions of the handle component extend through the plurality of handle sleeves. The exercise weight can also comprise void spaces located in between segments of the handle component and the central portion radially inward from the handle component.

20 Claims, 13 Drawing Sheets

(56) References Cited

U.S. PATENT DOCUMENTS 5,407,405 A * 4/1995 Oren ..... A63B 7/02 482/106
5,674,162 A * 10/1997 Ellingson ..... A63B 21/0608 482/110
5,692,944 A * 12/1997 Pellicone ..... A63B 21/0608 273/109
5,709,637 A * 1/1998 Gow ..... A63B 23/12 482/121
5,766,112 A * 6/1998 Chuan ..... A63B 21/045 482/121
6,217,401 B1 * 4/2001 Peterson ..... B63B 35/76 441/65
6,312,364 B1 * 11/2001 Selsam ..... A63B 21/06 206/501
6,500,102 B1 * 12/2002 Domenge ..... A63B 15/005 482/110
D469,484 S * 1/2003 Dawson ..... D21/662
6,730,004 B2 * 5/2004 Selsam ..... A63B 21/06 206/501
7,044,820 B2 * 5/2006 Ladisa ..... A63B 41/00 441/81
7,470,222 B1 * 12/2008 Mkrtchyan ..... A63B 21/22 446/236
7,785,240 B2 * 8/2010 Stugart ..... A63B 21/06 482/108
7,846,076 B2 * 12/2010 Salzwimmer ..... A63B 19/00 482/110
7,972,250 B2 * 7/2011 Viselman ..... A63B 21/072 482/141
8,061,368 B2 * 11/2011 Chudzik ..... A45D 8/36 132/273
D658,729 S * 5/2012 McLoughney ..... D21/682
8,382,647 B1 * 2/2013 Hodes ..... A63B 21/072 482/108
8,454,485 B1 * 6/2013 Hodes ..... A63B 21/0726 482/108
8,474,410 B2 * 7/2013 Oblack ..... A01K 15/025 119/709
8,608,628 B2 * 12/2013 Mathews ..... A63B 21/0602 482/108
8,814,765 B2 * 8/2014 Bernstein ..... A63B 21/0004 482/110
8,840,531 B2 * 9/2014 Viselman ..... A63B 21/00061 482/106
9,011,304 B2 * 4/2015 Gilman ..... A63B 21/00 482/139
D733,815 S * 7/2015 Gustafson ..... D21/694
D745,097 S * 12/2015 Webb ..... D21/682
9,468,806 B2 * 10/2016 Newman ..... A63B 23/16
9,907,990 B2 * 3/2018 Januszek ..... A63B 21/06
D818,062 S * 5/2018 Lien ..... D21/680
10,124,207 B2 * 11/2018 Artioli ..... A63B 21/072
2002/0010059 A1 * 1/2002 Selsam ..... A63B 21/06 482/93
2003/0134727 A1 * 7/2003 Yu ..... A63B 21/0004 482/110
2006/0048719 A1 * 3/2006 Myers ..... A01K 15/026 119/710
2006/0073951 A1 * 4/2006 Walkow ..... A63B 21/0601 482/109
2007/0084480 A1 * 4/2007 Chudzik ..... A45D 8/36 132/273
2009/0075792 A1 * 3/2009 Stugart ..... A63B 21/06 482/93
2009/0199784 A1 * 8/2009 Oblack ..... A01K 15/025 119/707
2009/0222994 A1 * 9/2009 Wood ..... A61H 15/0092 5/655.9
2010/0160123 A1 * 6/2010 Stugart ..... A63B 21/06 482/93
2011/0224054 A1 * 9/2011 Bernstein ..... A63B 21/0004 482/110
2011/0263394 A1 * 10/2011 Viselman ..... A63B 21/00061 482/93
2011/0287903 A1 * 11/2011 Mathews ..... A63B 21/0602 482/93
2013/0157823 A1 * 6/2013 Gilman ..... A63B 21/00 482/139
2013/0184123 A1 * 7/2013 McLoughney .... A63B 21/0004 482/8
2014/0073494 A1 * 3/2014 Mathews ..... A63B 21/0602 482/106
2014/0073496 A1 * 3/2014 Bannerman ..... A63B 21/0552 482/139
2014/0121064 A1 * 5/2014 Newman ..... A63B 23/16 482/49
2014/0179494 A1 * 6/2014 Mathews ..... A63B 21/0602 482/93
2016/0051855 A1 * 2/2016 Warren ..... A63B 21/0602 482/93
2018/0126213 A1 * 5/2018 Estrada, Jr. ..... A63B 21/00185

* cited by examiner

EXERCISE WEIGHTS AND METHODS OF MAKING EXERCISE WEIGHTS

RELATED APPLICATIONS

This application is a non-provisional of and claims the benefit of priority of U.S. Provisional Application No. 62/400,558 filed Sep. 27, 2016, the entirety of which is incorporated by reference.

FIELD OF TECHNOLOGY

The present disclosure relates generally to the field of exercise equipment for strength training, and, more specifically, to exercise weights and methods of making exercise weights.

BACKGROUND

Training with unconventional load-bearing exercise equipment, such as kettlebells, weight vests, and sandbags, has increased in popularity for professional and amateur athletes due to the rise of alternative sports such as cross-fit and obstacle course racing. However, such load-bearing exercise equipment is often beset by a myriad of disadvantages or shortcomings.

For example, kettlebells are usually designed with a single narrow handle attached to a load-bearing component. This design constrains the ways in which a user can lift the kettlebell; for example, by one hand or two hands placed in close proximity to one another. When such movements are performed repeatedly in the course of a kettlebell workout, the user can develop injuries to the user's neck, shoulder, and back. While weight vests provide a user with a greater range of motion, such vests are often designed solely to be worn around the user's body and are difficult to grasp or control when used in exercises typically meant for free weights. Moreover, while sandbags offer increase range of motion and can sometimes be used to substitute for free weights, sandbags are often difficult to grasp and their lack of rigidity can limit the type of exercises that a user can perform with such equipment.

Therefore, a solution is needed which does not limit the user's range of motion when performing load-bearing exercises using such equipment and opens the door for new exercise postures, motions, and possibilities. In addition, such equipment should be cost-effective to manufacture, portable, and able to withstand wear and tear in the course of usage.

SUMMARY

An exercise weight is disclosed. In one embodiment, the exercise weight can include a weight housing having a central portion. The weight housing can have at least two handle sleeves extending from a periphery of the central portion. In one example embodiment, the weight housing can be made of fabric.

The central portion can be filled by a weighted filling material. In one example embodiment, the weighted filling material can include iron sand. For example, the weighted filling material can comprise magnetite ($Fe_3O_4$) and trace amounts of silica, titanium, manganese, calcium, vanadium, or a combination thereof.

The exercise weight can also include a handle component surrounding the central portion. In certain embodiments, portions of the handle component can extend through the at least two handle sleeves. In one embodiment, the handle component can be made from one continuous segment of rope having a first rope end and a second rope end.

The first rope end can be coupled to the second rope end to form a ring-shape or substantially circular handle component. In this embodiment, the at least two handle sleeves can be arcuate to conform to a curvature of the handle component. When the handle component is made of one continuous segment of rope, the one continuous segment of rope can be covered by a thermoplastic layer to provide rigidity or stiffness to the handle component.

In addition, the at least two handle sleeves can connect the weight housing to the handle component. The at least two handle sleeves can be affixed to portions of the handle component or otherwise secured to the handle component by stitches made using polymeric threads along the periphery of the central portion. In other embodiments, the handle sleeves can be tightened around the handle component by reducing a cross-sectional diameter or size of a lumen within the handle sleeve. In addition to stitching, this can be done using staples, buttons, snaps, zippers, Velcro™, or a combination thereof. Moreover, at least two segments of the handle component can be exposed or left uncovered by the at least two handle sleeves.

The central portion of the weight housing can be covered by one or more neoprene patches. The central portion can also be defined by two concave surfaces along an exterior surface of the central portion.

The exercise weight can also have at least two void spaces located in between segments of the handle component and the central portion radially inward from the handle component. Each of the void spaces can be located in between a concave surface of the central portion and a segment of the handle component exposed or uncovered by the handle sleeves.

An alternative embodiment of the exercise weight is also disclosed. In this embodiment, the exercise weight can include a weight housing having a central portion. The weight housing can have a plurality of handle sleeves extending from a periphery of the central portion. In one example embodiment, the weight housing can be made of fabric.

The central portion can be filled by a weighted filling material. In one example embodiment, the weighted filling material can include fine-grained particulates. More specifically, the weighted filling material can include iron sand, silica particulates or other types of sand, clay, weighted balls, or a combination thereof.

The exercise weight can also include a handle component. The handle component can be made from two rope segments coupled to one another at both ends of the two rope segments. A thermoplastic layer can cover the two rope segments making up the handle component.

The plurality of handle sleeves can connect the weight housing to the handle component. In one embodiment, one of the two rope segments can extend through at least two of the plurality of handle sleeves and the other rope segment can extend through at least two other handle sleeves. Portions of the handle component can remain exposed or uncovered by the plurality of handle sleeves. The plurality of handle sleeves can be affixed to portions of the handle component by stitches made using polymeric threads along the periphery of the central portion. In other embodiments, the handle sleeves can be tightened around the handle component by reducing a cross-sectional diameter or size of a lumen within the handle sleeve. In addition to stitching, this can be done using staples, buttons, snaps, zippers, Velcro™, or a combination thereof.

The central portion of the weight housing can be covered by one or more neoprene patches. The central portion can also be defined by multiple concave surfaces along an exterior surface of the central portion.

The exercise weight can also have a plurality of void spaces located in between segments of the handle component and the central portion radially inward from the handle component. Each of the plurality of void spaces can be located in between a concave surface of the central portion and a segment of the handle component exposed or uncovered by the plurality of handle sleeves.

A method of making an exercise weight is also disclosed. The method can include forming a weight housing of the exercise weight by stitching together (e.g., using Nylon or other types of polymer threads) two pieces of fabric, where each of the two pieces of fabric comprises two outwardly arcuate sides and two inwardly curving sides. The method can also include forming at least two handle sleeves along a periphery of a central portion of the exercise weight. The method can also include sliding a handle component through the at least two handle sleeves. The method can further include affixing the at least two handle sleeves to portions of the handle component by stitching (e.g., using Nylon or other types of polymer threads) along the periphery of the central portion. In other embodiments, the handle sleeves can be tightened around the handle component by reducing a cross-sectional diameter or size of a lumen within the handle sleeve. In addition to stitching, this can be done using staples, buttons, snaps, zippers, Velcro™, or a combination thereof.

The method can also include filling the central portion with a weighted filling material through an opening along a surface of the central portion. In one embodiment, filling the central portion can include filling an expandable inner housing contained within the weight housing. Once the central portion is filled by the weighted filling material, two or more void spaces can be located in between segments of the handle component and the central portion. The method can also include covering a surface of the central portion with one or more neoprene patches.

The handle component can be formed from either a single continuous segment of rope or two rope segments. When the handle component is formed from a single continuous segment of rope, the method can include coupling one end of the single continuous segment of rope with another end of the single continuous segment of rope to form a ring-shaped or substantially circular handle.

DETAILED DESCRIPTION

Figure 1:
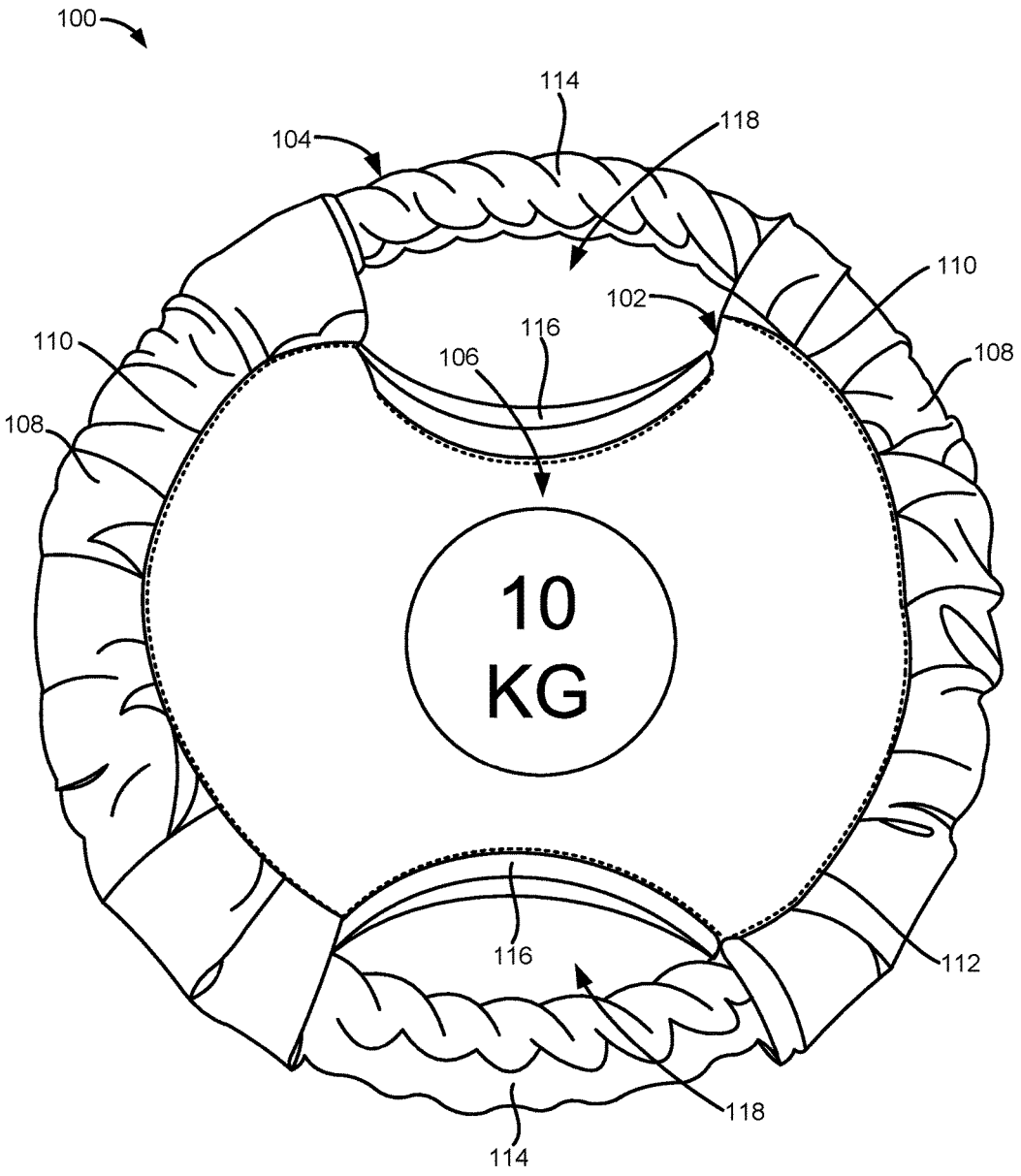
FIG. 1 illustrates an embodiment of an exercise weight.

FIG. 1 illustrates an embodiment of an exercise weight 100. In this embodiment, the exercise weight 100 can include a weight housing 102 and a handle component 104. The weight housing 102 can further include a central portion 106 and at least two handle sleeves 108 extending from a peripheral edge 110 of the central portion 106.

In one example embodiment, the weight housing 102 can be made of fabric. In some embodiments, the fabric can include a polymeric fabric such as nylon, heavy-duty nylon, ballistic nylon, coated nylon, polyester, elastane, latex, rubber, or a combination thereof. In other embodiments, the weight housing 102 can be made of any fabric composed of strands or filaments having a linear mass density of between 800-denier to 1000-denier. For example, the weight housing 102 can be made of Cordura® nylon fabric. As a more specific example, the weight housing 102 can be made of 1000-denier (1000 D) Cordura® nylon fabric. At least part of the weight housing 102 can be a fillable fabric bag or comprise a fillable bag.

In other embodiments not shown in the figures but contemplated by this disclosure, the weight housing 102 can be made of a rigid polymer or polymer casing. In these embodiments, the weight housing 102 can be molded into the shape or designs shown in the figures herein.

Figure 4A:
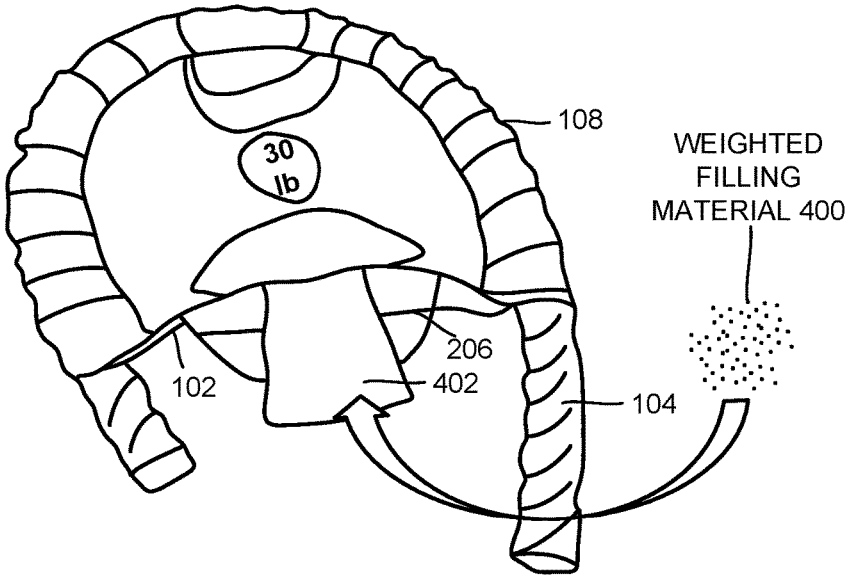
FIG. 4A is a black-and-white image of an embodiment of the handle component extending through handle sleeves of the weight housing.

The weight housing 102 can be filled by a weighted filling material 400 (see FIG. 4A). The weighted filling material 400 can include a flowable material such as a fluid, sand, dirt, rice, stone, marbles, metallic salts, or a combination thereof. For example, the weighted filling material 400 can include fine-grained iron particles or other types of particulates, such as iron sand, silica or other types of sand, weighted balls, clay, or a combination thereof. For example, the weighted filling material 400 can comprise magnetite ($Fe_3O_4$) and trace amounts of silica, titanium, manganese, calcium, vanadium, or a combination thereof. When the weighted filling material 400 is a fluid, the fluid can include water, other liquids, a gas, or a combination thereof.

In some embodiments, the weight housing 102 can house or contain an expandable inner housing 402 (see FIG. 4A). The expandable inner housing 402 can be filled by the weighted filling material 400 and expanded within the weight housing 102. In some embodiments, the expandable inner housing 402 can include a fabric bag or sac, a rubber bag or sac, a heavy-duty balloon, or a combination thereof. The expandable inner housing 402 can be used to contain the weighted filling material 400 rather than the weight housing 102 directly to provide an extra layer of protection to prevent the weighted filling material 400 from spilling out from the weight housing 102. In some embodiments, the expandable inner housing 402 can be coupled to an inner surface of the weight housing 102 by stitches, staples, buttons, clips, or a combination thereof.

In one embodiment, the expandable inner housing 402 can be made of nylon. More specifically, the expandable inner housing 402 can be made of 900-denier (900 D) nylon. In other example embodiments, the expandable inner housing 402 can be made of natural rubber, silicone, polyurethane, or a combination thereof.

The exercise weight 100 can also include a handle component 104 surrounding or circumscribing the central portion 106 of the weight housing 102. As shown in FIG. 1, portions of the handle component 104 can extend through the at least two handle sleeves 108.

Figure 3A:
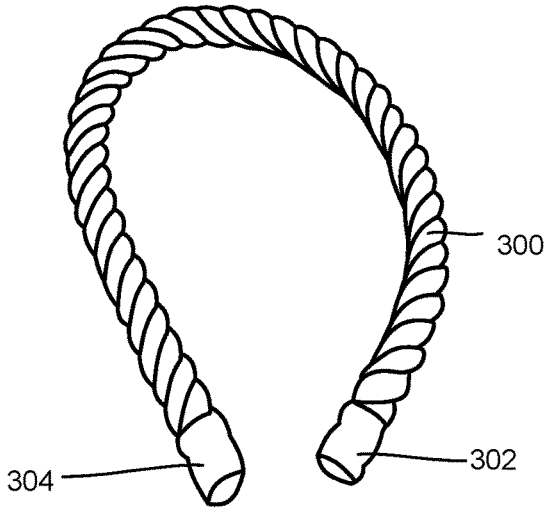
FIG. 3A is a black-and-white image of an embodiment of a continuous segment of rope used to make a handle component.

In some embodiments, the handle component 104 can be made from one continuous segment of rope 300 (see FIG. 3A). In this embodiment, the rope 300 can have a first rope end 302 and a second rope end 304 (see FIG. 3A). As will be discussed in the sections below, the first rope end 302 can be coupled to the second rope end 304 to form a ring-shape or hoop. The ring-shaped handle component 104 can be substantially circular, toroidal, or oval.

In one embodiment, the rope 300 can be a right hand lay rope. In other embodiments, the rope 300 can be a left hand lay rope. In certain embodiments, the rope 300 can be a polymeric rope such as a polypropylene rope. In these embodiments, the rope 300 can have a transverse cross-sectional rope diameter of between 20 mm and 50 mm.

Figure 3B:
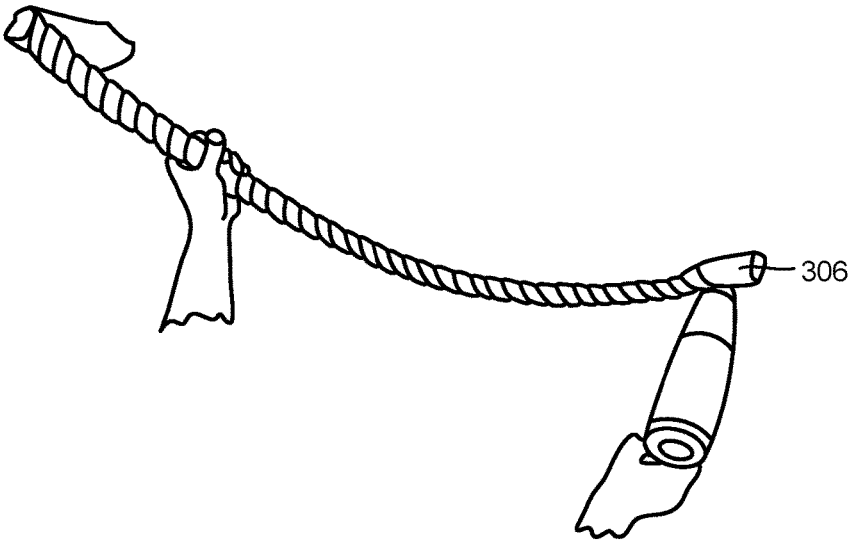
FIG. 3B is a black-and-white image of an embodiment of a thermoplastic layer being applied to a rope to make the handle component.

When the handle component 104 is made of one continuous segment of rope 300, the rope 300 can be covered or coated by a thermoplastic layer 306 (see FIG. 3B). Covering the rope 300 with the thermoplastic layer 306 enhances or adds to rigidity or stiffness of the handle component 104. For example, the thermoplastic layer 306 can prevent the rope 300 from twisting when held. Moreover, the thermoplastic layer 306 can prevent the rope 300 from fraying or becoming undone through overuse or over-handling. In addition, the thermoplastic layer 306 can act as a soft or smooth handle surface for the handle component 104 and prevent the user from experiencing rope burn. In one embodiment, the thermoplastic layer 306 can make the rope 300 rigid, stiff, or difficult to bend.

As shown in FIG. 1, the at least two handle sleeves 108 can be arcuate or outwardly bow-shaped to conform to the curvature of the ring-shaped handle component 104. Also, as shown in FIG. 1, the at least two handle sleeves 108 can be pleated or folded to better secure the handle sleeves 108 to the handle component 104. For example, the two handle sleeves 108 can be pleated or folded to better accommodate the grooves, pitch, or turns of the rope 300 making up the handle component 104. The handle sleeves 108 can be pleated or folded by pushing or otherwise urging the two ends of each of the handle sleeves 108 toward one another until pleats or folds are formed in between the two ends of each of the handle sleeves 108.

The at least two handle sleeves 108 can be used to connect or attach the weight housing 102 to the handle component 104. In one embodiment, stitches 112 can be made along one or more peripheral edges 110 of the central portion 106 to affix the handle sleeves 108 to the handle component 104 when the handle component 104 is thread or otherwise extended through lumens of the handle sleeves 108. For example, once the stiches 112 are made along the peripheral edges 110 of the central portion 106, the weight housing 102 can be secured to the handle component 104 and prevented from moving circumferentially around the ring-shaped or substantially circular handle component 104. In one embodiment, the stiches 112 can be made using nylon thread. As a more specific example, the stitches 112 can be made using 420-denier nylon thread. In other example embodiments, the stitches 112 can be made using mercerized cotton thread or heavy-duty cotton thread.

In other embodiments, the weight housing 102 can be affixed or secured to the handle component 104 by adhesives, stretch fitting, clips, buttons, straps, zippers, Velcro®, or a combination thereof. For example, the handle sleeves 108 can be tightened around the handle component 104 by reducing a cross-sectional diameter or size of a lumen within the handle sleeve 108. In addition to stitching, this can be done using staples, buttons, snaps, zippers, Velcro™, or a combination thereof.

As shown in FIG. 1, at least two segments of the handle component 104 can be exposed or left uncovered by the at least two handle sleeves 108. Such segments are shown in FIG. 1 as the uncovered segments 114. A user can grasp the uncovered segments 114 when performing certain exercises with the exercise weight 100. In other embodiments, the same user can also grasp portions of the handle component 104 covered by the handle sleeves 108 to perform other exercises using the exercise weight 100.

In addition, the central portion 106 can be defined by at least two concave surfaces 116 along the exterior of the central portion 106. As will be discussed in the following sections, the concave surfaces 116 can be formed as a result of the shape or design of the fabric pieces 200 (see FIG. 2A).

The exercise weight 100 can also be defined by at least two void spaces 118. The at least two void spaces can be located in between segments of the handle component 104 and the central portion 106 radially inward from the handle component 104. For example, as shown in FIG. 1, one void space 118 can be located in between one of the concave surfaces 116 of the central portion 106 and one of the uncovered segments 114 of the handle component 104. The void spaces 118 can allow a user to extend the user's hands into the void space 118 in order to grasp the central portion 106 of the weight housing 102 and/or to allow the user to curl the user's fingers around the uncovered segments 114 of the handle component 104.

Figure 2A:
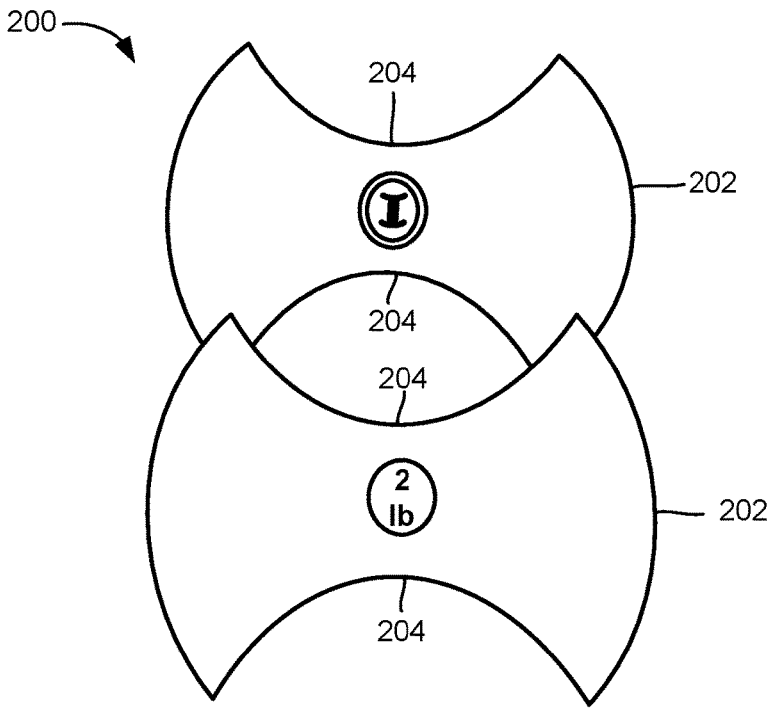
FIG. 2A is a black-and-white image of an embodiment of fabric pieces used to construct a weight housing of the exercise weight.

FIG. 2A is a black-and-white image of an embodiment of fabric pieces 200 used to construct the weight housing 102. As shown in FIG. 2A, the weight housing 102 can be made or fabricated from two fabric pieces 200. In one embodiment, the fabric pieces 200 can be bow-tie shaped.

More specifically, as shown in FIG. 2A, each of the fabric pieces 200 can have two arcuate edges 202 and two hyperbola-shaped edges 204. The two arcuate edges 202 can be lateral or side edges of the fabric pieces 200. The two arcuate edges 202 can be opposite one another or diametrically opposed to one another. The two hyperbola-shaped edges 204 can be curved edges which define a hyperbola shape or contour along the top and bottom edges of the fabric pieces 200.

In one embodiment, the two fabric pieces 200 can be coupled together or sewn together using the stitches 112 previously described. In another embodiment, the two fabric pieces 200 can be coupled together using adhesives, staples, or a combination thereof.

Figure 2B:
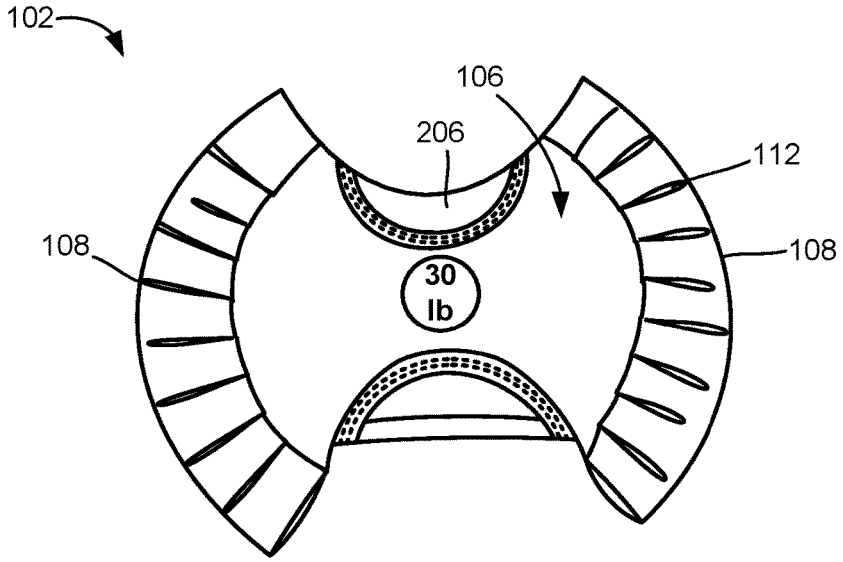
FIG. 2B is a black-and-white image of an embodiment of a weight housing of the exercise weight.

FIG. 2B is a black-and-white image of an embodiment of a finished weight housing 102 made from the two fabric pieces 200. As shown in FIG. 2B, the central portion 106 of the weight housing 102 can be covered by one or more neoprene patches 206. The neoprene patches 206 can be coupled or sewn on to the central portion 106 of the weight housing 102 using stitches 112. The neoprene patches 206 can protect surfaces or areas of the weight housing 102 from wear and tear. For example, the neoprene patches 206 can cover the concave surfaces 116 of the weight housing 102. In some embodiments, the neoprene patches 206 can be used to define the concave surfaces 116 of the weight housing 102. In other embodiments, the neoprene patches 206 can cover areas or surfaces of the weight housing 102 proximal to the uncovered segments 114 of the handle component 104. The neoprene patches 206 can also provide rigidity or support to the fabric outer layer of the weight housing 102.

As shown in FIGS. 2A and 2B, the arcuate edges 202 of the two fabric pieces 200 can be pleated and sewn together to form the arcuate or outwardly bow-shaped handle sleeves 108 of the weight housing 102. The two handle sleeves 108 can be pleated or folded to better affix or secure the handle sleeves 108 to the handle component 104.

The inner cavity or the fillable portion of the weight housing 102 can be formed by sewing along the perimeter or periphery of the fabric pieces 200 and leaving the center uncoupled or unattached. For example, the central portion 106 of the weight housing 102 can be formed by first forming the handle sleeves 108 using the arcuate edges 202 of the fabric pieces 200 and subsequently sewing along the two hyperbola-shaped edges 204. As will be shown in the following sections, one of the two hyperbola-shaped edges 204 can initially be left open so as allow the expandable inner housing 402 to be inserted into the central portion 106.

FIG. 3A is a black-and-white image of an embodiment of the rope 300 used to make the handle component 104. In one embodiment, the rope 300 can be a polymer rope, such as a polypropylene rope. In other embodiments, the rope 300 can be an organic fiber rope or a metallic rope.

FIG. 3B is a black-and-white image of an embodiment of the thermoplastic layer 306 covering the rope 300. In one embodiment, the thermoplastic layer 306 can be applied to the rope 300 by heating a heat shrinkable polymer tubing over the rope 300. The thermoplastic layer 306 can comprise any of polytetrafluoroethylene (PTFE), polyvinylidene fluoride (PVDF), polyolefin tubes, Viton™ or other synthetic rubber, fluorinated ethylene propylene (FEP), or a combination thereof. When the thermoplastic layer 306 is a heat shrinkable polymer, the thermoplastic layer 306 can be applied to the rope 300 using a heat gun or heat blower.

FIG. 4A is a black-and-white image of an embodiment of the handle component 104 extending through handle sleeves 108 of the weight housing 102. As shown FIG. 4A, one continuous segment of rope 300 can be slid or thread through the lumens of the two handle sleeves 108 to form the handle component 104. In this embodiment, the one continuous segment of rope 300 can be covered by the thermoplastic layer 306. The first rope end 302 can be uncoupled or unconnected to the second rope end 304 until the weight housing 102 or the expandable inner housing 402 within the weight housing 102 is filled by the weighted filling material 400.

The weighted filling material 400 can be introduced or delivered through a funnel, siphon, hose, tube, or a combination thereof into the weight housing 102, the expandable inner housing 402, or a combination thereof. The weighted filling material 400 can be introduced or delivered to the weight housing 102 or the expandable inner housing 402 through an opening along a surface of the central portion 106. For example, as shown in FIG. 4A, one of the neoprene patches 206 covering a concave surface 116 of the central portion 106 can be left unsewn or unattached. In this embodiment, the hyperbola-shaped edge 204 contiguous to the neoprene patch 206 can also be left unsewn or unattached. A portion of the expandable inner housing 402 can then be pulled or otherwise brought through this opening on the central portion 106 and the weighted filling material 400 can be introduced into the expandable inner housing 402.

The weighted filling material 400 can fill the weight housing 102 until the total weight of the exercise weight 100 is between 1 lb. and 50 lbs. In other embodiments, the weighted filling material 400 can fill the weight housing 102 until the total weight of the exercise weight 100 is between 1 kg and 50 kg. In further embodiments, the total weight of the exercise weight 100 can be in excess of 50 lbs. or 50 kg.

After filling the expandable inner housing 402 or the weight housing 102 with the weighted filling material 400, the expandable inner housing 402 or the weight housing 102 can be sewn closed or otherwise sealed, stitched, stapled, or plugged closed.

After sealing or closing the weight housing 102, the first rope end 302 can be coupled to the second rope end 304 as will be described in the following sections.

Figure 4B:
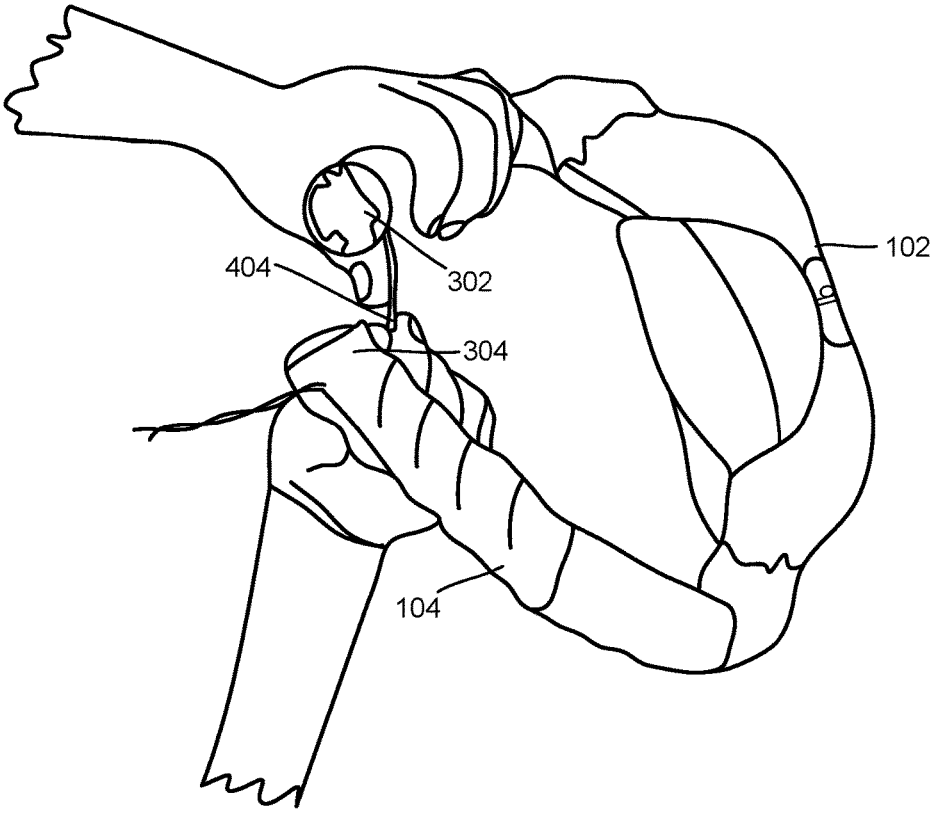
FIG. 4B is a black-and-white image of an embodiment of the handle component being formed into a ring-shape.

FIG. 4B is a black-and-white image of an embodiment of the handle component 104 being formed into a ring-shape or hoop. As shown in FIG. 4B, the handle component 104 can be made of one continuous segment of rope 300 slid or thread through the two handle sleeves 108. The one continuous segment of rope 300 can be curled into a ring-shape or hoop and the first rope end 302 can be coupled to the second rope end 304.

As shown in FIG. 4B, the first rope end 302 can be coupled to the second rope end 304 using one or more wires 404. The wires 404 can be forced or stuck through a radial outer surface of the rope 300 in a direction perpendicular to the longitudinal axis of the rope 300. The wires 404 can be forced or stuck through both the first rope end 302 and the second rope end 304 and subsequently connected by twisting or tying the wires 404 together. The first rope end 302 and the second rope end 304 connected by the wires 404 can then be covered by a thermoplastic layer 306 such as a polymeric tube heat shrunk onto the connected rope segments.

Figure 5A:
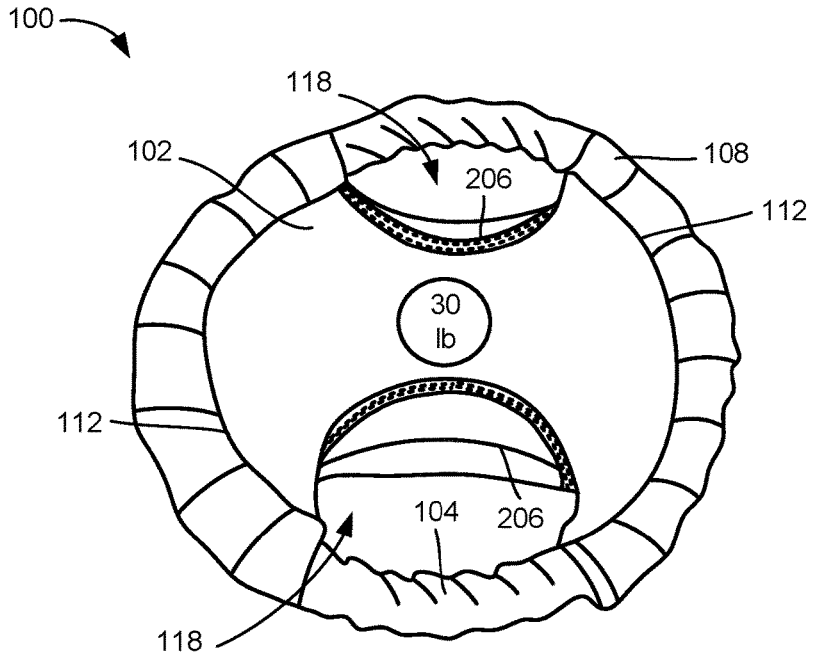
FIG. 5A is a black-and-white image depicting a top view of an embodiment of the exercise weight.

FIG. 5A is a black-and-white image depicting a top view of an embodiment of an assembled exercise weight 100. The plurality of handle sleeves 108 can be affixed to portions of the handle component 104 by stitches 112 made along the peripheral edges 110 of the central portion 106. For example, the stitches 112 can narrow or constrict the opening or lumen within the handle sleeves 108 to fit tightly around the handle component 104. In other embodiments not shown in the figures, the plurality of handle sleeves 108 can be secured to portions of the handle component 104 by reducing a diameter or size of the lumen within the handle sleeve 108 when at least a segment of the handle component 104 is positioned within the lumen.

Also, as seen in FIG. 5A, two or more void spaces 118 can be located in between the uncovered segments 114 of the handle component 104 and the concave surfaces 116 along the exterior surface of the central portion 106. The void spaces 118 can allow a user to insert the hands or fingers of the user through the void spaces 118 to grasp the central portion 106, the handle component 104, or a combination thereof when engaging in an exercise routine with the exercise weight 100. As shown in FIG. 5A, the concave surfaces 116 can also be covered by the neoprene patches 206 to protect the concave surfaces 116 from wear and tear from continued contact with the hands or fingers of the user.

Figure 5B:
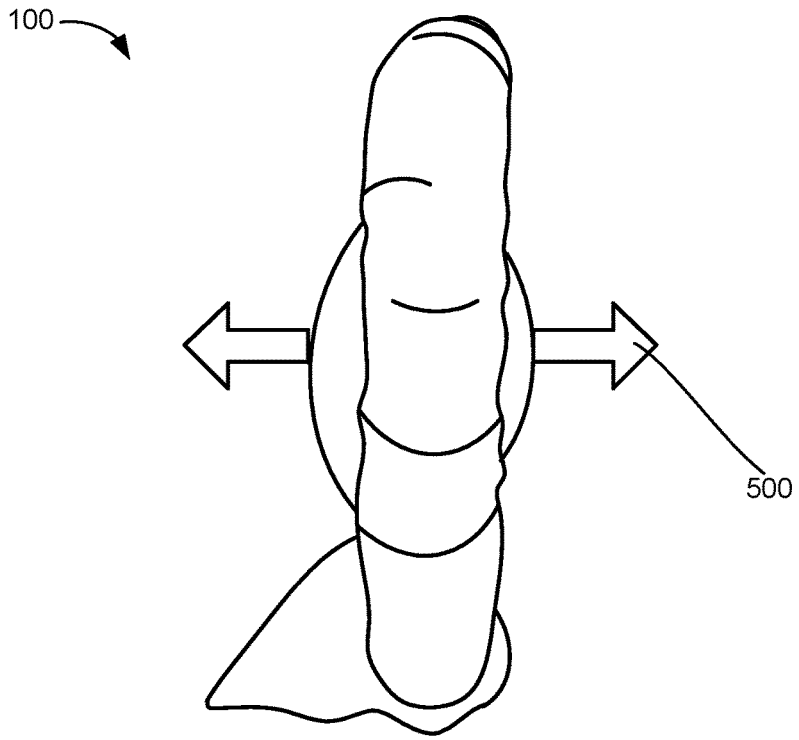
FIG. 5B is a black-and-white image depicting a side view of an embodiment of the exercise weight.

FIG. 5B is a black-and-white image depicting a side view of an embodiment of the exercise weight 100. As shown in FIG. 5B, the central portion 106 of the weight housing 102, the expandable inner housing 402, or a combination thereof can be filled such that the weight housing 102, the expandable inner housing 402, or a combination thereof is expanded or bulges out in a direction 500 orthogonal or perpendicular to a plane bisecting or transverse to the ring-shaped handle component 104. In some embodiments, the central portion 106 of the weight housing 102, the expandable inner housing 402, or a combination thereof can also expand or bulge out slightly in a radial direction toward the handle component 104 circumscribing the central portion 106. The expansion of the central portion 106 in the direction 500 orthogonal or perpendicular to a plane bisecting or transverse to the ring-shaped handle component 104 allows the void spaces 118 to remain generally, or for the most part, unobstructed by the central portion 106 of the weight housing 102 when filled.

FIGS. 6A-6D are black-and-white images depicting a range of exercises being performed using an embodiment of the exercise weight 100. One of the many advantages of the exercise weight 100 disclosed herein is the ability for users to engage in novel exercises previously impossible or difficult to perform using traditional free weights or kettlebells.

Figure 6A:
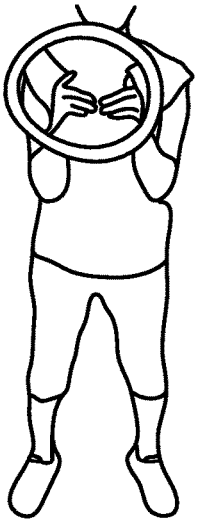
FIGS. 6A-6D are black-and-white images depicting exercises being performed using an embodiment of the exercise weight.

As shown in FIG. 6A-6D, many such exercises are enhanced or improved when performed using the exercise weight 100. For example, as shown in FIG. 6A, a two-handled bicep curl can be performed by holding the concave surfaces 116 along the central portion 106 of the exercise weight 100. Moreover, the user can then grasp the handle component 104 and perform additional two-handed bicep curls with hands further apart from those shown in FIG. 6A. Furthermore, the user can also switch hand grips in midair by releasing one two-handed grip (e.g., holding the ring-shaped or substantially circular handle component 104) and switching to another two-handed grip (e.g., holding the central portion 106) in midair to improve the user's reflexes. Such an exercise is nearly impossible to accomplish using traditional weight plates or kettlebells.

Figure 6B:
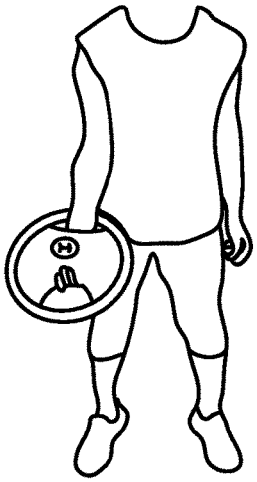

Also, as shown in FIG. 6B, a user can perform a one-handed bicep curl by extending the hand, wrist, and/or part of the forearm of the user through one void space 118 and holding on to one of the concave surfaces 116 with the fingers of the user. By performing one-handed bicep curls in this manner using the exercise weight 100, the segment of the handle component 104 in contact with the forearm of the user stabilizes the forearm to help isolate the bicep muscles of the user. Moreover, a user feels more secure when grasping the exercise weight 100 with one hand in this manner.

Figure 6C:
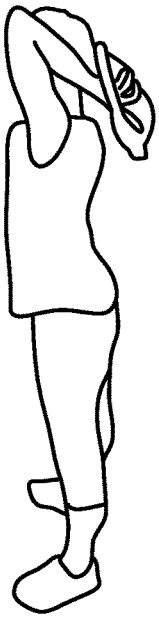

FIG. 6C illustrates a standing tricep curl performed using the exercise weight 100. In this exercise, the user can grasp the central portion 106 with both hands and rest a part of the user's forearm, wrist, or hand on the ring-shaped or substantially circular handle component 104 while performing the tricep curl. When a tricep curl is performed in this manner, the handle component 104 stabilizes the user's forearm and helps isolate the user's tricep muscle during this exercise.

Figure 6D:
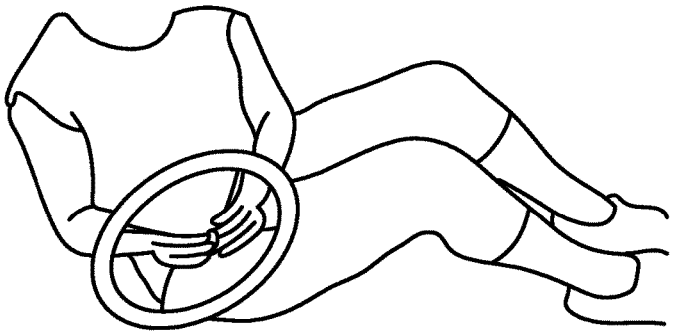

FIG. 6D illustrates a twisting oblique sit-up performed using the exercise weight 100. As shown in FIG. 6D, the user can grasp the central portion 106 of the exercise weight 100 when performing twisting oblique sit-ups. When undertaking this exercise using the exercise weight 100, the ring-shaped or substantially circular handle component 104 ensures the user twists enough to clear the entirety of the handle component 104 over the user's legs. This forces the user to perform more proper and demanding oblique sit-ups.

Although not shown in the figures, the user can also perform wrist strengthening exercises or wrist curls by grasping a portion of the handle component 104 with one or two hands and slowly curling the exercise weight 100 with the user's wrist or wrists. In addition, the user can also perform rotating bicep or tricep curls by grasping the handle component 104 of the exercise weight 100 with both hands and simultaneously curling the exercise weight 100 and rotating the handle component 104 in a clockwise or counterclockwise direction. Such novel exercises are currently difficult or awkward to perform with existing free weights, kettlebells, or weight vests. Although not shown in the figures, all such exercises can also be performed using an embodiment of the exercise weight shown in FIG. 7.

Figure 7:
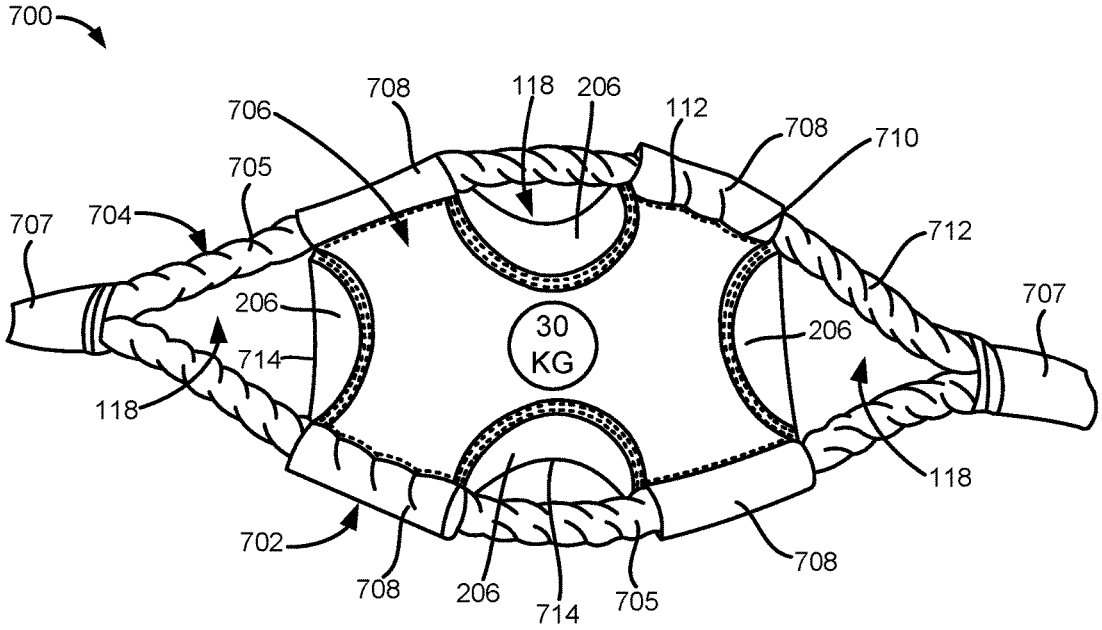
FIG. 7 illustrates another embodiment of an exercise weight.

FIG. 7 illustrates an alternative embodiment of an exercise weight 700. In this and other embodiments, the exercise weight 700 can include a weight housing 702 having a central portion 706 and a plurality of handle sleeves 708 extending from peripheral edges 710 of the central portion 706. As shown in FIG. 7, the exercise weight 700 can have four handle sleeves 708 extending from peripheral edges 710 of the central portion 706 of the exercise weight 700. In other embodiments, the exercise weight 700 can have between five and ten handle sleeves 708 extending from peripheral edges 710 of the central portion 706 of the exercise weight 700.

In one example embodiment, the weight housing 702 can be made of fabric similar to the weight housing 102 of exercise weight 100. For example, the weight housing 702 can be made of 1000-denier (1000 D) Cordura® nylon fabric.

The central portion 706 can be filled by the weighted filling material 400. In one example embodiment, the weighted filling material 400 can comprise fine-grained particulates such as iron sand, silica or other types of sand, clay, weighted balls, or a combination thereof. For example, the weighted filling material 400 can comprise magnetite ($Fe_3O_4$) and trace amounts of silica, titanium, manganese, calcium, vanadium, or a combination thereof.

The exercise weight 700 can also include a handle component 704. The handle component 704 can be made from two separate or unconnected segments of rope 705 (for example, the same type of rope as rope 300 of FIG. 3A) coupled or affixed to one another at both ends of the separate segments of rope 705. The two segments of rope 705 can be polymeric ropes such as polypropylene ropes. The two segments of rope 705 can also be covered by a thermoplastic layer 707 (which can be the same type of thermoplastic as the thermoplastic layer 306).

Covering the ropes 705 with the thermoplastic layer 707 enhances or adds to the rigidity or stiffness of the handle component 704. For example, the thermoplastic layer 707 can prevent the ropes 705 from twisting when held. Moreover, the thermoplastic layer 707 can prevent the ropes 705 from fraying or becoming undone through overuse or overhandling. In addition, the thermoplastic layer 707 can act as a soft or smooth handle surface for the handle component 704 and prevent the user from experiencing rope burn. In one embodiment, the thermoplastic layer 707 can make the handle component 704 rigid, stiff, or difficult to bend.

The plurality of handle sleeves 708 can connect the weight housing 702 to the handle component 704. In one embodiment, one of the two segments of rope 705 can extend through at least two of the plurality of handle sleeves 708 and the other segment of rope 705 can extend through at least two other handle sleeves 708. In this and other embodiments, the first two handle sleeves 708 can be on one side of the central portion 706 and the second two handle sleeves 708 can be on an opposite side of the central portion 706.

Portions of the handle component 704 can remain exposed or uncovered by the plurality of handle sleeves 708. The segments of the handle component 704 not covered by the plurality of handle sleeves 708 can be referred to in this disclosure as the uncovered segments 712. For example, as shown in FIG. 7, the exercise weight 700 can have six uncovered segments 712 of the handle component 704. In other embodiments, the uncovered segments 712 can range between four and eight or above depending on the number of handle sleeves 708.

The handle component 704 can be formed by coupling the ends of the two separate and unconnected segments of rope 705 with one another. For example, as shown in FIG. 9B, two segments of rope 705 covered by the thermoplastic layer 707 can be initially coupled by metallic wires 404 (for example, by twisting the metallic wires 404 together or inserting the metallic wires 404 through the ends of the two ropes 705 and then twisting the metallic wires 404 together). In this embodiment, the two rope ends coupled together by the metallic wires 404 can then be covered by heat-shrink tubes heated by a heat gun or heat blower to conform the heat-shrink tubes to the shape of the two rope ends. In this embodiment, the heat-shrink tubes can serve as additional thermoplastic layers 707 covering the thermoplastic layers 707 already covering the ropes 705.

The plurality of handle sleeves 708 can be affixed to positions or segments along the handle component 704 by stitches 112 made using polymeric threads (e.g., Nylon threads) along or near the peripheral edges 710 of the central portion 706. For example, as shown in FIG. 7, the four handle sleeves 708 can be affixed to different positions along segments of the handle component 704 by stitches 112 made along four peripheral edges 710 of the central portion 706. In other embodiments, the handle sleeves 708 can be affixed to the handle component 704 by adhesives, staples, snaps, buttons, clasps, or a combination thereof. For example, the handle sleeves 708 can be tightened around the handle component 704 by reducing a cross-sectional diameter or size of a lumen within the handle sleeve 708. In addition to stitching, this can be done using staples, buttons, snaps, zippers, Velcro™, or a combination thereof.

As shown in FIG. 7, the handle sleeves 708 can also be pleated or folded to better conform to or be easier to affix to the grooves or turns of the rope 705 making up the handle component 704.

The central portion 706 can also be defined by multiple concave surfaces 714 along the exterior of the central portion 706. In addition, the exercise weight 700 can also have multiple void spaces 118 located in between the concave surfaces 714 and the uncovered segments 712. For example, as shown in FIG. 7, the exercise weight 700 can have four void spaces 118 located in between the various concave surfaces 714 and the uncovered segments 712.

As shown in FIG. 7, the assembled exercise weight 700 can be lens-shaped or oval-shaped having an elliptical-shaped middle and pointed ends. The handle component 704 can define the contour or outer edge of the lens-shaped exercise weight 700.

Similar to the exercise weight 100, the weighted filling material 400 can fill the weight housing 702 of the exercise weight 700 until the total weight of the exercise weight 700 is between 1 lb. and 50 lbs. In other embodiments, the weighted filling material 400 can fill the weight housing 702 until the total weight of the exercise weight 700 is between 1 kg and 50 kg. In further embodiments, the total weight of the exercise weight 700 can be in excess of 50 lbs. or 50 kg. In other embodiments, the weight housing 702 can comprise an expandable inner housing attached or affixed to an interior of the weight housing 702. The expandable inner housing can be a bag or compartment made of 900-denier (900 D) nylon. In other embodiments, the expandable inner housing can be made of natural rubber, silicone, polyurethane, or a combination thereof.

Figure 8:
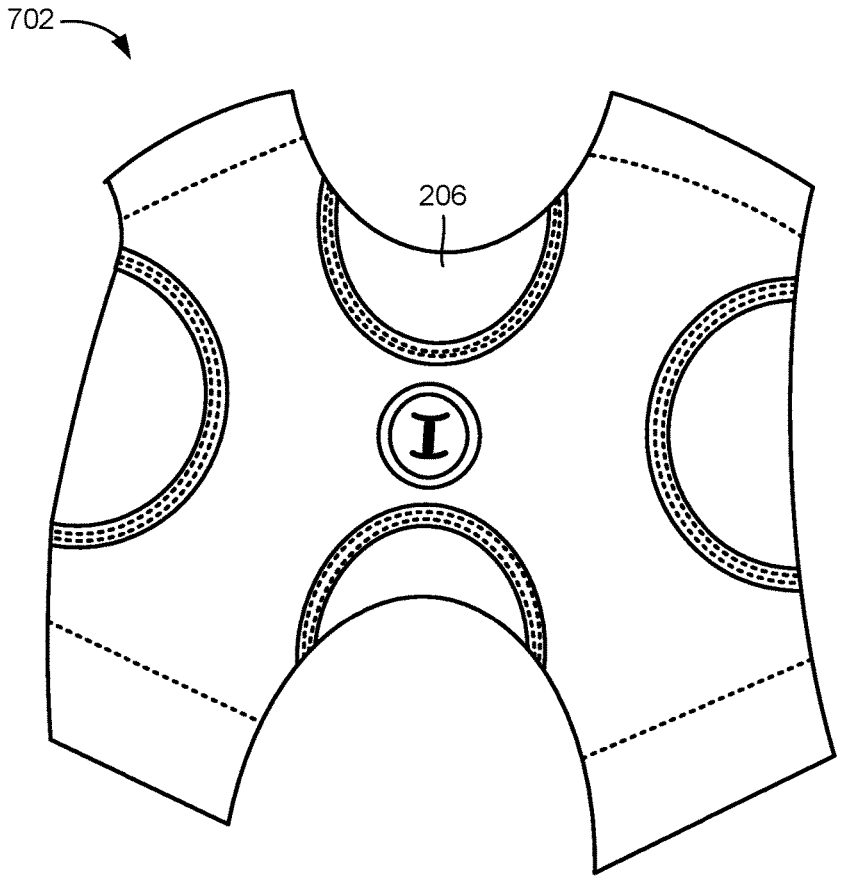
FIG. 8 is a black-and-white image of another embodiment of a weight housing.

FIG. 8 is a black-and-white image of an embodiment of the weight housing 702 during the assembly process. FIG. 8 shows that the weight housing 702 can be substantially H-shaped. Also shown in FIG. 8 is that the central portion 706 of the weight housing 702 can be covered by one or more neoprene patches 206. The neoprene patches 206 can protect the concave surfaces 714 from wear and tear due to contact with the hands or other body parts of the user. The weight housing 702 can be made from two pieces of fabric cut or made substantially into an H-shape. The two pieces of fabric can be sewn together and the handle sleeves 708 can be formed along the leg ends of the H-shaped fabric.

Figure 9A:
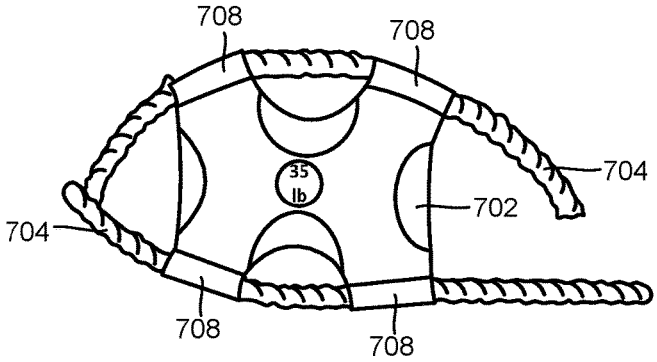
FIGS. 9A-9C are black-and-white images depicting assembly of another embodiment of the exercise weight.
Figure 9B:
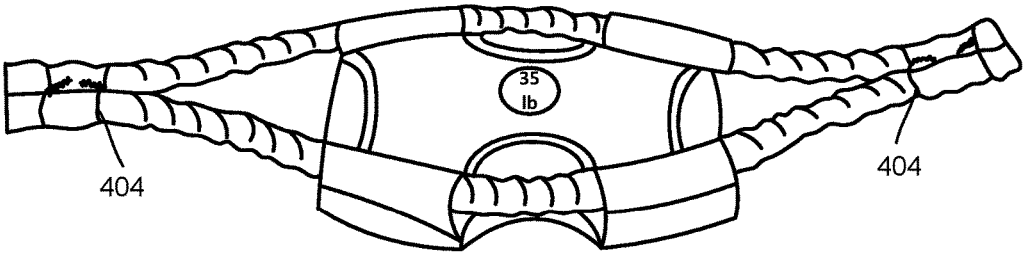
Figure 9C:
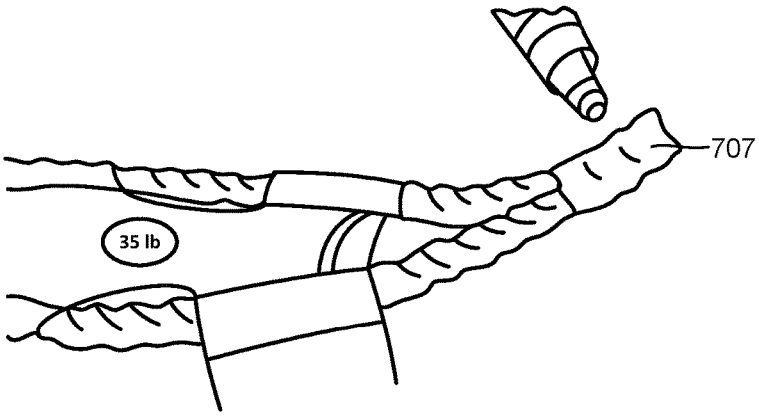

FIGS. 9A-9C are black-and-white images depicting assembly of the exercise weight 700. FIG. 9A depicts that two unconnected segments of rope 705 can each be thread through two different handle sleeves 708. The two unconnected segments of rope 705 can be covered or coated by the thermoplastic layer 707. For example, one segment of rope 705 can extend through two handle sleeves 708 along a top edge of the weight housing 702 and another segment of rope 705 unconnected to the first segment of rope 705 can extend through two other handle sleeves 708 along a bottom edge of the weight housing 702. The two unconnected segments of rope 705 can then be coupled together to form the handle component 704.

FIG. 9B depicts that the two unconnected segments of rope 705 can be coupled together using wires 404. For example, the two ends of the two segments of rope 705 can be coupled together with metallic wires 404 twisted or clasped around the two ends.

FIG. 9C depicts that both ends of the two segments of rope 705 can be covered by a thermoplastic layer 707, such as heat-shrink tubing heated onto the ends by a heat gun or heat blower.

Figure 10:
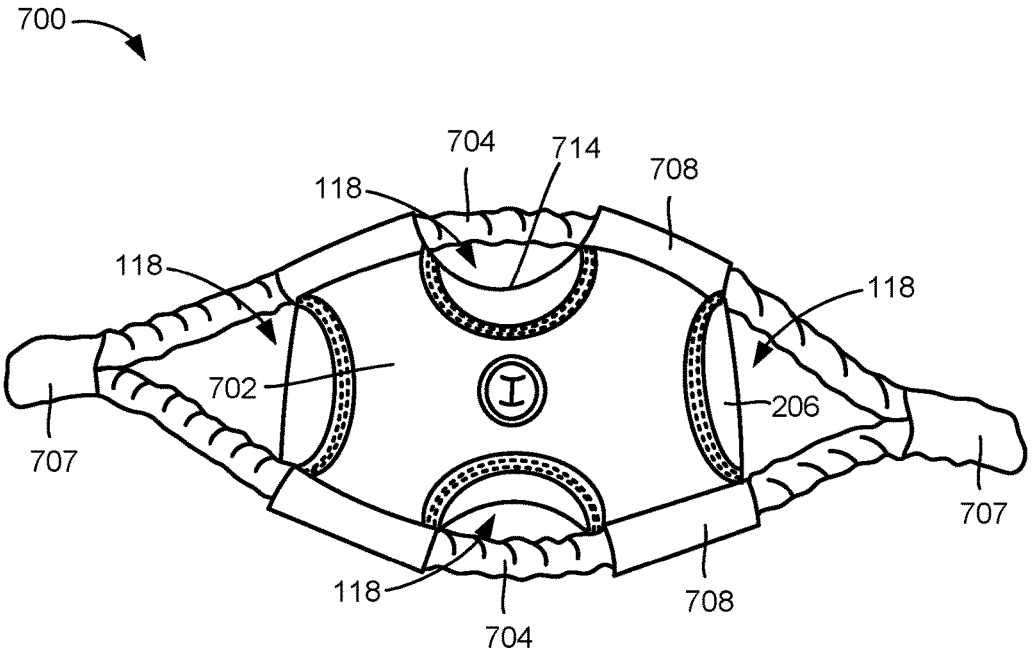
FIG. 10 is a black-and-white image of another embodiment of an assembled exercise weight.

FIG. 10 is a black-and-white image of an embodiment of an assembled exercise weight 700. As shown in FIG. 10, the handle component 704 can be substantially lens-shaped or oval-shaped with converging ends. The central portion 706 of the weight housing 702 can be filled such that the central portion 706 bulges or expands outward.

Figure 11A:
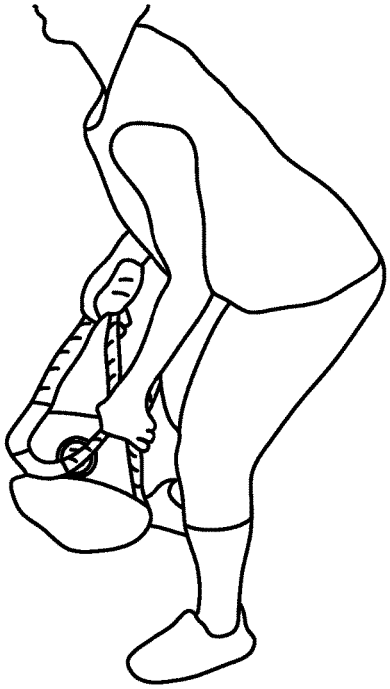
FIGS. 11A-11B are black-and-white images depicting exercises being performed using another embodiment of the exercise weight.
Figure 11B:
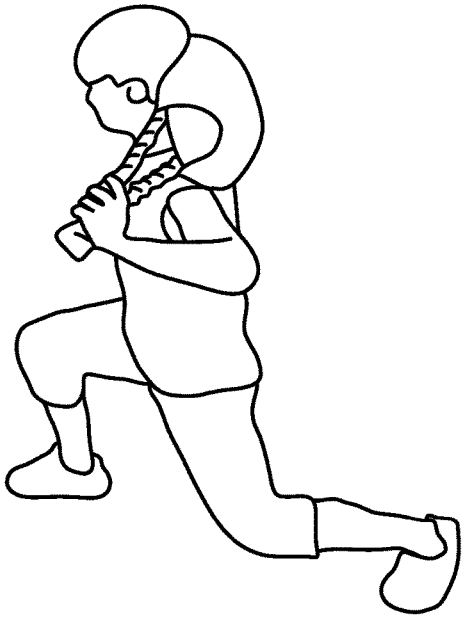

FIGS. 11A-11B are black-and-white images depicting exercises being performed using the exercise weight 700. As depicted in FIG. 11A, a user can perform a dead-lift by holding onto the coupled ends of the handle component 704. While performing such a dead-lift the user can also extend out the user's arms away from the user's midline while holding onto the coupled ends of the handle component 704. Performing a dead-lift in this manner also works out the user's pectoral and rotator cuff muscles.

FIG. 11B depicts a user performing a lunging squat while carrying the exercise weight 700 on the shoulders and upper back of the user. As shown in FIG. 11B, the user can grasp the handle component 704 while performing such a squat to stabilize the exercise weight 700 on the user's upper back and shoulders.

One benefit of the exercise weight 100, the exercise weight 700, or a combination thereof is the ability to perform exercises previously impossible or impractical with traditional free weights. Another benefit of the exercise weight 100, the exercise weight 700, or a combination thereof is the unique weight distribution of the weighted central portion relative to the handle component.

Figure 12:
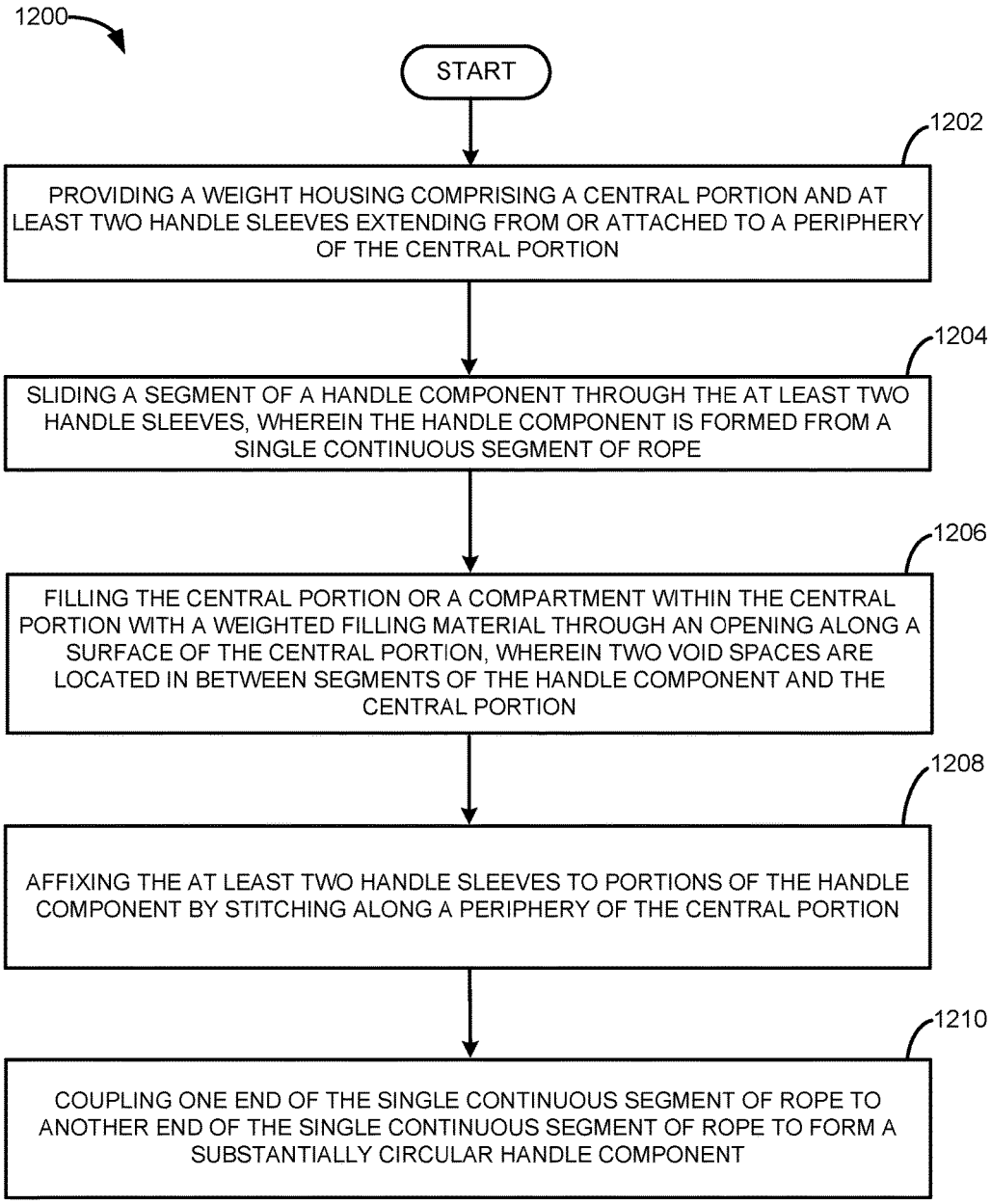
FIG. 12 illustrates steps of an example method of making an embodiment of the exercise weight.

FIG. 12 illustrates an example method 1200 of making an exercise weight 100. The method 1200 can involve providing a weight housing 102 comprising a central portion 106 and at least two handle sleeves 108 extending from or attached to a periphery of the central portion 106 in a step 1202. The method 1200 can also involve sliding a handle component 104 through the at least two handle sleeves 108, wherein the handle component 104 is formed from a single continuous segment of rope 300 in a step 1204. At least a portion of the single continuous segment of rope 300 can be covered by a thermoplastic layer 306. The method 1200 can also involve filling the central portion 106 or a compartment within the central portion 106 with a weighted filling material 400 through an opening along a surface of the central portion 106 in a step 1206. Two or more void spaces 118 can be located in between segments of the handle component 104 and the central portion 106 when the central portion 106 or the compartment within the central portion 106 is filled by the weight filling material 400. The method 1200 can also involve affixing the at least two handle sleeves 108 to portions of the handle component 104 by stitching along a periphery of the central portion 106 in a step 1208. In other embodiments, the handle sleeves 108 can be tightened around the handle component 104 by reducing a cross-sectional diameter or size of a lumen within each of the handle sleeves 108. In addition to stitching, this can be done using staples, buttons, snaps, zippers, Velcro™, or a combination thereof. The method 1200 can also involve coupling one end of the single continuous segment of rope 300 to another end of the single continuous segment of rope 300 to form a substantially circular handle component 104 in a step 1210.

Figure 13:
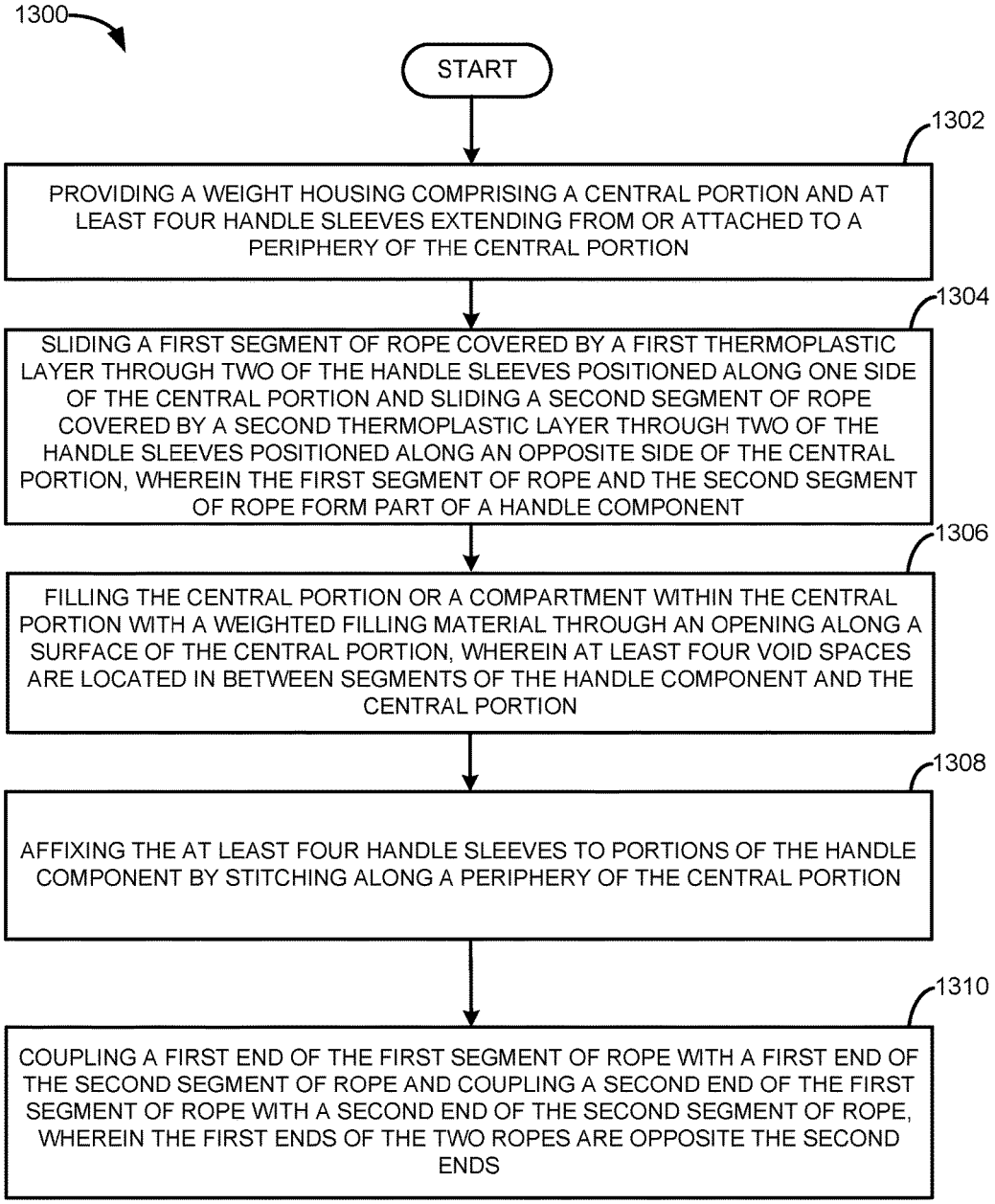
FIG. 13 illustrates steps of an example method of making another embodiment of the exercise weight.

FIG. 13 illustrates an example method 1300 of making an exercise weight 700. The method 1300 can involve providing a weight housing 702 comprising a central portion 706 and at least four handle sleeves 708 extending from or attached to a periphery of the central portion 706 in a step 1302. The method 1300 can also involve sliding a first segment of rope 705 covered by a first thermoplastic layer 707 through two of the handle sleeves 708 positioned along one side of the central portion 706 and sliding a second segment of rope 705 covered by a second thermoplastic layer 707 through two of the handle sleeves 708 positioned along an opposite side of the central portion 706 in a step 1304. The first segment of rope 705 and the second segment of rope 705 are initially separate and unconnected ropes when the first segment of rope 705 and the second segment of rope 705 are slid through the handle sleeves 708. The first segment of rope 705 and the second segment of rope 705 form part of a handle component 704. The method 1300 can also involve filling the central portion 706 with a weighted filling material 400 through an opening along a surface of the central portion 706, wherein at least four void spaces 118 are located in between segments of the handle component 704 and the central portion 706 in a step 1306. The method 1300 can also involve affixing the at least four handle sleeves 708 to portions of the handle component 704 by stitching using polymeric threads along a periphery of the central portion 706 in a step 1308.

In other embodiments, the handle sleeves 708 can be tightened around the handle component 704 by reducing a cross-sectional diameter or size of a lumen within each of the handle sleeves 708. In addition to stitching, this can be done using staples, buttons, snaps, zippers, Velcro™, or a combination thereof. The method 1300 can further involve coupling a first end of the first segment of rope 705 to a first end of the second segment of rope 705 and coupling a second end of the first segment of rope 705 to a second end of the second segment of rope 705 in a step 1310. The first ends of the first segment of rope 705 and the second segment of rope 705 are opposite the second ends of the first segment of rope 705 and the second segment of rope 705. In one embodiment, the coupling can be done using additional heat-shrinkable thermoplastic coverings or additional thermoplastic layers 707.

A number of embodiments have been described. Nevertheless, it will be understood by one of ordinary skill in the art that various changes and modifications can be made to this disclosure without departing from the spirit and scope of the embodiments. Elements of systems, devices, apparatus, and methods shown with any embodiment are exemplary for the specific embodiment and can be used in combination or otherwise on other embodiments within this disclosure.

For example, the steps of any methods depicted in the figures or described in this disclosure do not require the particular order or sequential order shown or described to achieve the desired results. In addition, other steps operations may be provided, or steps or operations may be eliminated or omitted from the described methods or processes to achieve the desired results. Moreover, any components or parts of any apparatus or systems described in this disclosure or depicted in the figures may be removed, eliminated, or omitted to achieve the desired results. In addition, certain components or parts of the systems, devices, or apparatus shown or described herein have been omitted for the sake of succinctness and clarity.

Accordingly, other embodiments are within the scope of the following claims and the specification and/or drawings may be regarded in an illustrative rather than a restrictive sense.

I claim:

1. An exercise weight, comprising:

a weight housing comprising a central portion and at least two handle sleeves extending from a periphery of the central portion, wherein the central portion is fillable by a weighted filling material; and a handle component surrounding the central portion, wherein portions of the handle component extend through the at least two handle sleeves, wherein the handle component is ring-shaped and wherein the at least two handle sleeves connects the weight housing to the handle component, wherein at least two segments of the handle component are uncovered by the at least two handle sleeves, and wherein at least two void spaces are located in between segments of the handle component and the central portion radially inward from the handle component.

2. The exercise weight of claim 1, wherein the handle component is made from one continuous segment of rope having a first rope end and a second rope end, wherein the first rope end is coupled to the second rope end to form the ring-shape.

3. The exercise weight of claim 2, wherein the handle component further comprises a thermoplastic layer covering the one continuous segment of rope and wherein the thermoplastic layer provides rigidity to the one continuous segment of rope.

4. The exercise weight of claim 2, wherein the first rope end of the one continuous segment of rope is coupled to the second rope end by one or more metallic wires and wherein a thermoplastic layer is heat shrunk onto the first rope end and the second rope end when the first rope end is connected to the second rope end.

5. The exercise weight of claim 1, wherein the weight housing is made of fabric.

6. The exercise weight of claim 1, wherein the at least two handle sleeves are arcuate to conform to a curvature of the handle component.

7. The exercise weight of claim 6, wherein the at least two handle sleeves are pleated.

8. The exercise weight of claim 1, wherein the weight housing further comprises at least two concave surfaces on the central portion, wherein at least one of the two void spaces is positioned in between one of the two concave surfaces and a segment of the handle component uncovered by the handle sleeves.

9. The exercise weight of claim 8, wherein each of the concave surfaces on the central portion of the weight housing is substantially hyperbola-shaped.

10. The exercise weight of claim 1, wherein the central portion is covered by one or more neoprene patches.

11. The exercise weight of claim 1, wherein the weighted filling material comprise iron sand and the central portion comprises the weighted filling material.

12. The exercise weight of claim 1, wherein the at least two handle sleeves are affixed to portions of the handle component by stitches made along the periphery of the central portion.

13. The exercise weight of claim 1, wherein each of the two void spaces are substantially biconvex-shaped.

14. An exercise weight, comprising:

a weight housing comprising a central portion and a plurality of handle sleeves extending from a periphery of the central portion, wherein the central portion is fillable by a weighted filling material; and a handle component comprising two rope segments and wherein the plurality of handle sleeves connects the weight housing to the handle component, wherein one of the two rope segments extends through at least two of the plurality of handle sleeves and the other rope segment extends through at least two other handle sleeves, wherein the two rope segments are coupled to one another at both ends of the two rope segments, wherein portions of the handle component are uncovered by the plurality of handle sleeves, and wherein a plurality of void spaces are located in between segments of the handle component and the central portion of the weight housing.

15. The exercise weight of claim 14, wherein the handle component further comprises a thermoplastic layer covering the two rope segments and wherein the thermoplastic layer provides rigidity to the two rope segments.

16. The exercise weight of claim 14, wherein the weight housing is made of fabric.

17. The exercise weight of claim 14, wherein the plurality of handle sleeves are affixed to portions of the handle component by stitches made along the periphery of the central portion.

18. The exercise weight of claim 14, wherein the weighted filling material comprise iron sand and the central portion comprises the weighted filling material.

19. The exercise weight of claim 14, wherein the weight housing further comprises at least two concave surfaces on the central portion, wherein at least one of the two void spaces is positioned in between one of the two concave surfaces and a segment of the handle component uncovered by the handle sleeves.

20. The exercise weight of claim 19, wherein each of the concave surfaces on the central portion of the weight housing is substantially hyperbola-shaped.

* * * * *